United States Patent [19]

Englert et al.

[11] 3,949,025

[45] Apr. 6, 1976

[54] VARIABLE THROAT VENTURI APPARATUS FOR MIXING AND MODULATING LIQUID FUEL AND INTAKE AIR TO AN INTERNAL COMBUSTION ENGINE

[75] Inventors: Robert Dixon Englert, Corona Del Mar; Kenneth Ronald Armstrong, Lakewood; Lester Porter Berriman, Irvine, all of Calif.

[73] Assignee: Dresser Industries, Inc., Dallas, Tex.

[22] Filed: Jan. 4, 1974

[21] Appl. No.: 430,808

[52] U.S. Cl. .... 261/62; 261/DIG. 56; 261/DIG. 58; 138/45

[51] Int. Cl.[2] ..... F02M 9/06

[58] Field of Search..... 261/DIG. 56, 62, DIG. 58; 138/45

[56] References Cited

UNITED STATES PATENTS

| | | | |
|---|---|---|---|
| 868,251 | 10/1907 | Bollee | 261/DIG. 58 |
| 1,067,449 | 7/1913 | Steward | 261/DIG. 59 |
| 1,319,158 | 11/1919 | Little | 261/DIG. 58 |
| 1,542,415 | 6/1925 | Richardson | 261/DIG. 56 |
| 1,555,489 | 9/1925 | Spencer et al. | 261/DIG. 58 |
| 2,052,225 | 8/1936 | Hartshorn | 261/DIG. 56 |
| 2,468,416 | 4/1949 | Stresen-Reuter | 261/DIG. 56 |
| 3,778,038 | 12/1973 | Eversole et al. | 261/62 |

*Primary Examiner*—Tim R. Miles

*Attorney, Agent, or Firm*—Robert W. Mayer; John N. Hazelwood; Daniel Rubin

[57] ABSTRACT

Discharge velocity of the air-fuel mixture being supplied through a variable venturi flow passage device to an internal combustion engine at idle to near idle operation of the engine is optimized by controllably varying the area ratio between the throat and exit planes of the device. Opposite jaw faces of the device define the flow passage that is gradually opened and closed in correlation to demand imposed on the engine between idle and full throttle operation. Area ratio control in one form is achieved by apparatus operative to selectively vary the diffuser angle between the opposing jaw faces. Area ratio control in another form is achieved by apparatus operative to effect a localized passage opening at idle of selectively different aspect ratio than the aspect ratio defined over the full longitudinal extent of the jaw faces.

11 Claims, 17 Drawing Figures

VARIABLE THROAT VENTURI APPARATUS FOR MIXING AND MODULATING LIQUID FUEL AND INTAKE AIR TO AN INTERNAL COMBUSTION ENGINE

CROSS REFERENCE TO RELATED APPLICATIONS

1. Ser. No. 381,946 filed July 23, 1973 and entitled "Variable Venturi Apparatus for Mixing and Modulating Liquid Fuel and Intake Air for Internal Combustion Engines" incorporated herein by reference (hereinafter "CR-1"); and 2. Ser. No. 384,166 filed July 30, 1973 and entitled "Fuel Introduction Device for Internal Combustion Engines" incorporated herein by reference (hereinafter "CR-2").

BACKGROUND OF THE INVENTION

1. The field of art to which the invention pertains includes the art of internal conbustion engines and more particularly to such art as it applies to fuel and air induction systems therefor.

2. In by far the majority of currently used gasoline engines commercially marketed for automotive applications, fuel and air are metered and mixed by a carburetor connected to the intake manifold of the engine. Although these carburetors vary in detail from one manufacturer to the other, they are essentially similar and have over the years been regarded as generally satisfactory in supplying an adequate combustion mix to the engine.

Disclosed in cross reference application CR-1 is an improved apparatus for mixing fuel with air under substantially continuous sonic conditions and modulating the quantity of combustible fuel mix to meet operating demands of the engine with which it is utilized. Unlike a conventional carburetor, the apparatus of CR-1 generally comprises an elongated housing having a central passage defined in a venturi cross section intervening between the edge facings of opposite jaw faces supported in a fixed angular relation to each other. Varying the venturi flow area in accord with requirements is effected by changes to the passage in either a lateral or longitudinal plane. Air and fuel are received in an intake duct above the venturi throat at which sonic velocity is imparted to the mixture for achieving reduced emission of undesirable pollutants from the engine exhaust. A diffuser extanding immediately downstream from the throat efficiently recovers kinetic energy (velocity head) as pressure head and thereby enables sonic velocity at the throat to be maintained over substantially the entire operating range of the engine. Loss of sonic velocity through the throat occurs at low manifold vacuums (high absolute pressure) and is termed the "unchoke point".

While the device of CR-1 has been found to operate exceedingly well in meeting automotive emission standards established by governmental codes, some difficulty has been experienced in maintaining optimum engine performance throughout the operating range, particularly at idle and near idle conditions. Generally speaking, it has been difficult to maintain velocity of the mixture discharging from the diffuser exit to the engine manifold to within about 30 to 500 ft/sec. preferably to within about 100 to about 400 ft/sec. Exit velocities lower than minimum tend to recirculation and agglomeration of fuel drops in the diffuser while velocities higher than maximum tend to undesirable impaction of fuel drops in the intake manifold. In either direction away from the recommended range, degradation of mixture becomes increasingly worse resulting in a reduction in emission benefits.

Variation of flow area through the device of CR-1 from idle to fill throttle has been by lateral displacement of one or both mirror-like jaws of fixed length defining the venturi passage. In this arrangement, passage spacing at the venturi throat reduces at idle to an extremely narrow gap of high aspect ratio. For a 350 CID engine, the typical idle gap in this arrangement has been on the order of about 0.015 to 0.025 inches as compared to the gaps at wide open throttle (WOT) of between about 0.4 to 0.5 inches. Hence, with a constant diffuser length, i.e., measured from the throat to the exit plane in the direction of flow, the ratio of diffuser length to gap width is substantially greater at idle than at WOT. At the same time, area ratio between the exit and throat planes of the device is substantially increased at idle. Because of variation in area ratio with throttle opening a diffuser sized for WOT will incur a decreasing terminal velocity of the discharge mixture past the exit plane from several hundred feet/second to under 100 ft/sec. and even less than 30 ft/sec. at idle. Conversely, sizing the diffuser for idle operation can render the discharge velocity at WOT exceedingly high.

SUMMARY OF THE INVENTION

This invention relates to improvements for idle operation of a variable venturi apparatus supplying an air-fuel mixture through a venturi passage between opposing jaws to an internal combustion engine. More specifically, the invention relates to improvements to apparatus of a type disclosed in cross referenced application CR-1 whereby to afford enhanced idle performance without the attendant growth of fuel drops or impaction of fuel drops, previously associated therewith. This is obtained in accordance herewith by alternative forms of the invention affording controlled variation in the area ratio between the exit and throat planes of the device. In one form of the invention the slot between the opposing jaws is longitudinally narrowed at idle to a localized gap having a predetermined aspect ratio measured at the venturi throat selectively different than the aspect ratio defined by a corresponding area over the full longitudinal extent of the jaw faces. In a second form of the invention the apparatus is operative to selectively decrease the diffuser angle as idle operation is approached.

It is therefore an object of the invention to effect enhanced idle operation with a variable venturi apparatus supplying an air-fuel mixture to an internal combustion engine.

It is a further object of the invention to effect the previous object with a more economical construction able to achieve enhanced idle operation without sacrifice in performance from idle to full throttle operating conditions of the device.

It is a still further object of the invention to effect the foregoing objects by controllably varying exit velocity of the discharging air-fuel mixture to within a predetermined range in which the fuel droplet size formed by the device can be preserved for supply to the engine.

Figure 1:
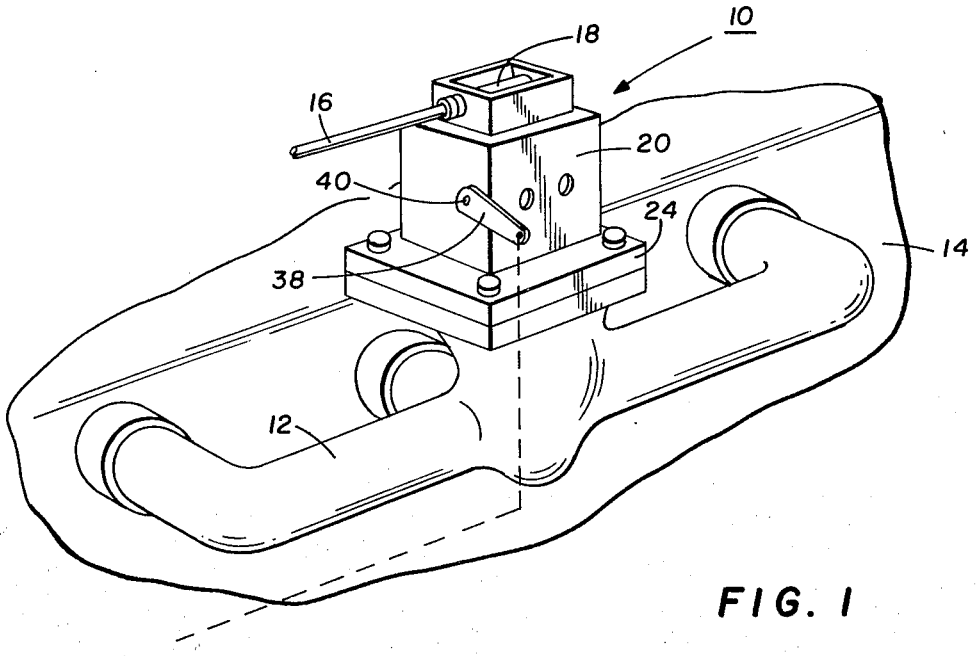
FIG. 1 is an isometric representation of an air fuel device in accordance herewith for supplying a combustible mixture to an internal combustion engine.

Reference is now made to the drawings and particularly to FIG. 1 in which there is shown a mixing and modulating apparatus 10 of a type more completely disclosed in co-pending patent application CR-1. The apparatus is supported on an intake manifold 12 of an internal combustion engine 14. Air for combustion is drawn from the ambient environment for mixing with liquid fuel supplied via conduit 16 from an automotive fuel tank (not shown). Conduit 16 in turn connects to a fuel bar 18 which may, for example, be of a type disclosed in cross referenced application CR-2.

Figure 2:
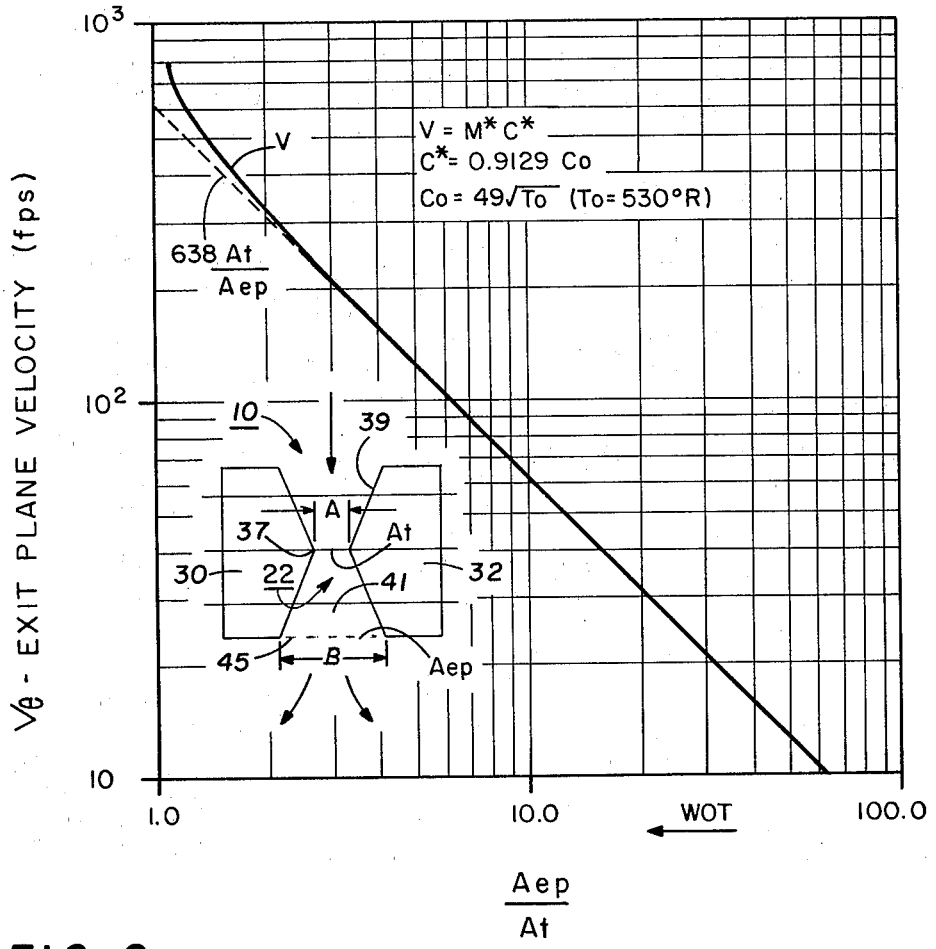
FIG. 2 is a logarithmic graph and schematic representation of operation for the variable venturi device disclosed in copending application CR-1.

Prior operation of apparatus 10, insofar as it relates to the invention hereof, can be understood with reference to the graph and schematic representation of FIG. 2. As shown therein, apparatus 10 is comprised of two opposed jaws 30 and 32 between which is defined a venturi flow passage 22. Air and fuel are received in an intake 39 from which the mixture passes through throat constriction 37 into diffuser 41 before being discharged into the engine manifold at the diffuser termination or exit 45. Engine demand is accommodated by displacing jaws 30 and 32 laterally toward or apart from each other in approaching idle and WOT, respectively. Displacement movement is correlated to maintain sonic velocity past throat 37 for reasons more fully explained in application CR-1.

With a passage 22 of fixed length throughout its height, and a constant velocity (sonic) past throat 37, the velocity of the mixture at exit 45 for any given setting (ignoring extraneous factors) can be related to the ratio of passage exit area (Aep)/to passage throat area (At). Where length is common, the ratio of Aep-/At for any given displacement setting can be defined directly in terms of their relative widths "A" and "B".

The curve of FIG. 2 graphically illustrates the increase in exit velocity Ve (fps) at the unchoke point of operation as the jaws are increasingly displaced toward WOT operation. It can be seen, therefore, that at unchoke conditions Ve is related to area ratio and to approximate an isentropic flow expansion, can be defined by the following equation:

$$Ve\ (\text{fps}) = \frac{638}{At/Aep}$$

The above velocities then correspond to ratios of *Aep-/At* of:

| Ve (fps) | Aep/At | At/Aep |
|---|---|---|
| 30 | 21 | 0.047 |
| 100 | 6.4 | 0.157 |
| 400 | 1.6 | 0.627 |
| 500 | 1.3 | 0.784 |

This approximation varies below area ratios of about 3 from the theoretical velocity V calculated for a single temperature of 530°R.

Referring now more particularly to FIGS. 3–6, apparatus 10 comprises an elongated housing 20 having an internally central flow passage 22 adapted to communicate in a vertical direction with intake manifold 12. A rectangular base 24 mounts the apparatus in position on the manifold. Forming the housing are a plurality of contiguous right angle supports including in one direction a pair of opposite stationary slab walls 26 and 28 and in a perpendicular direction thereto a pair of the aforementioned wall or jaw members 30 and 32. The jaw members are symetrically mirror-like in construction supported opposite hand with their edge facings 34 and 36 defining passage 22 in a venturi cross section extending vertically therebetween. The narrowest portion 37 of the passage comprises the throat whereas portion 39 above the throat comprises the intake and portion 41 below the throat comprises the diffuser. For reasons indicated in the co-pending CR-1 application, intake angle $\alpha$ is generally between 0° to 90° and diffuser angle $\beta$ is preferably between 3½° to 10°.

For responding to demand imposed on the engine, one or both jaw members are movable laterally relative to both the flow axis and to each other in order to increase and decrease throat area *At* as required without affecting the angular relation of their edge facings. Jaw movement originates via the automobile throttle linkage which operably connects to a sector arm 38 on the exterior of housing 20. The sector arm is in turn secured to a pivotally operable cross shaft 40 extending through slab wall 28 and supported in stationary blocks 42 and 44 positioned intermediate slab walls 26 and 28. Secured on shaft 40 is a cam plate 46 having a predefined pitch 47 which via a follower pin 48 is effective when rotated to displace jaw member 32 laterally toward and away from jaw member 30.

In accordance with the invention hereof, jaw 32 includes a cutout or recess 50 extending rearward from its front face from where it is symetrically enlarged beyond shoulder 55 into cavity 52. Contained within the cavity is an idle jaw 54 having a front face 56 symetrically corresponding in a vertical direction with that of jaw 32. The longitudinal throat dimension "X" of jaw 54 is generally coterminous with that of recess 50, and about ⅓ to ½ the full longitudinal dimension of jaw 32. Laterally beyond shoulder 57, the jaw sidewalls fit closely within cavity 52 to be slideable in piston-like fashion therein. The longitudinal backside of jaw 54 includes lateral bores 58 and 60 aligning with opposite bores 62 and 63 penetrating inward from cavity 52. Contained within the opposing bores are compressed springs 64 and 66 acting to urge idle jaw 54 forwardly toward jaw 30. A bolt 68, threaded into the backside of jaw 54 and secured via a nut 70 to block wall 42, limits the forwardmost movement thereof as to define idle slot 51. As shown, the idle slot is of a width "Y" (measured at the plane of throat 37). Width "Y" can be readily preadjusted by appropriately lengthening or shortening the effective operating length of bolt 68. When in the idle relation, jaw 32 extends forward of jaw 54 to define a lateral spacing "D" between the backside of jaw 54 and the inside face of cavity 52.

In the foregoing arrangement, jaw 32 is operably displaceable by cam 46 to correspondingly, in like increments, increase dimensions "A" and "B" (FIG. 2) between jaws in response to engine demands from idle to full throttle operation. As driving conditions are initiated, jaw 32 is gradually displaced away from jaw 30 until its shoulder 55 gradually engages jaw shoulder 57. Thereafter, jaws 32 and 54 displace rearwardly in unison by virtue of the shoulder engagements in combination with the biasing force exerted by springs 64 and 66. On deceleration toward idle, the reverse occurs as jaws likewise move concomitantly in unison until jaw 54 reaches the limit of travel permitted by the setting of bolt 68. Thereafter, jaw 32 continues toward a closing engagement with opposite jaw 30 while jaw 54 remains stationary and slideable relative to jaw 32 until forming idle slot 51.

Since longitudinal dimension "X" of slot 51 is about ⅓ to ½ the full longitudinal dimension of jaw 32, a constant throat area At required to maintain sonic velocity at idle with jaw 54 requires a slot width "Y" inversely proportioned to the prior art idle width "A". That is, with At constant for idle in either arrangement, halving the length requires doubling the width and vice versa. Incidental to increasing the throat width in that manner is the resulting decrease in area ratio *Aep/At* effecting a consequent increase in exit velocity of the discharging air fuel mixture past exit 45. Summarily speaking, maintaining flow area by decreasing aspect ratio results in a decrease of area ratio *Aep/At.*

Figure 7:
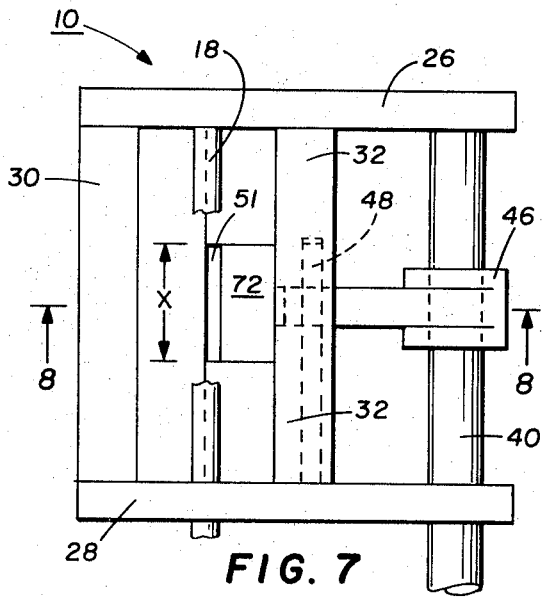
FIG. 7 is a plan view partially in section of a first alternative embodiment.
Figure 8:
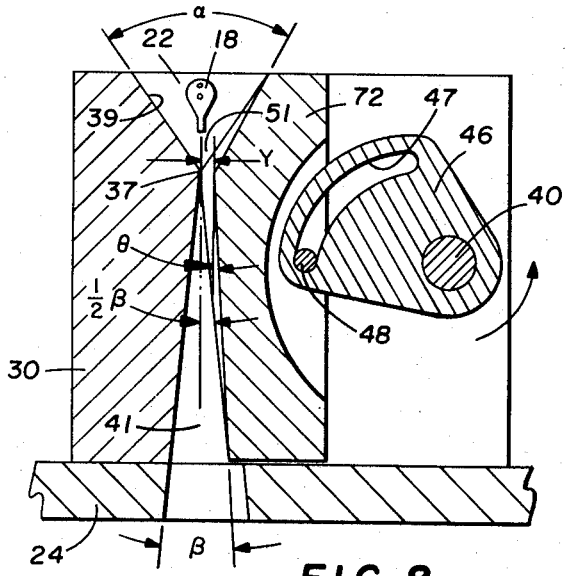
FIG. 8 is a sectional elevation taken substantially along the lines 8—8 of FIG. 7.

Reference is now made to FIGS 7 and 8 illustrating a second embodiment for obtaining idle slot control in accordance herewith. Unlike the previous embodiment, the idle jaw here designated 72 is not relatively movable but is instead integrally part of jaw 32 having been formed by a recess cutout in the center portion thereof. In this arrangement, therefore, idle spacing "Y" for slot 51 represents a permanent recess at idle section 72 longitudinally intermediate the remaining throat portions of jaw 32. Also included in this embodiment is a diffuser face angle $\phi$ on the recessed member less than the ½ $\beta$ angle on the remainder of the jaw face further contributing to a decreased area ratio *Aep/At* by means of a reduced longitudinal dimension "X".

Figure 9:
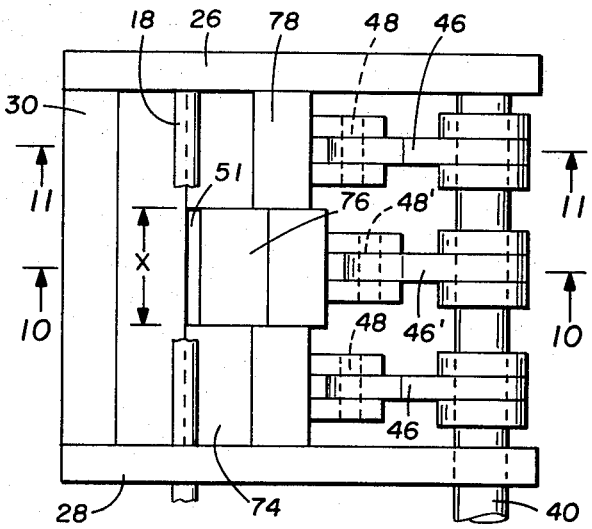
FIG. 9 is a plan view partially in section of a second alternative embodiment.
Figure 10:
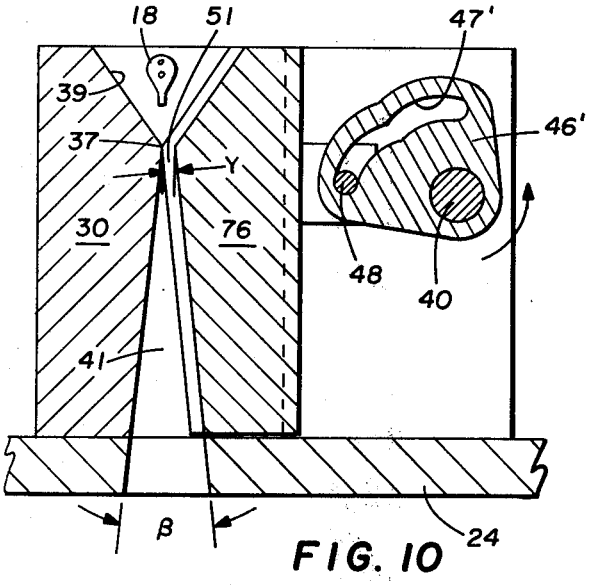
FIGS. 10 and 11 are sectional elevations taken substantially along the lines 10—10 and 11—11, respectively, of FIG. 9.
Figure 11:
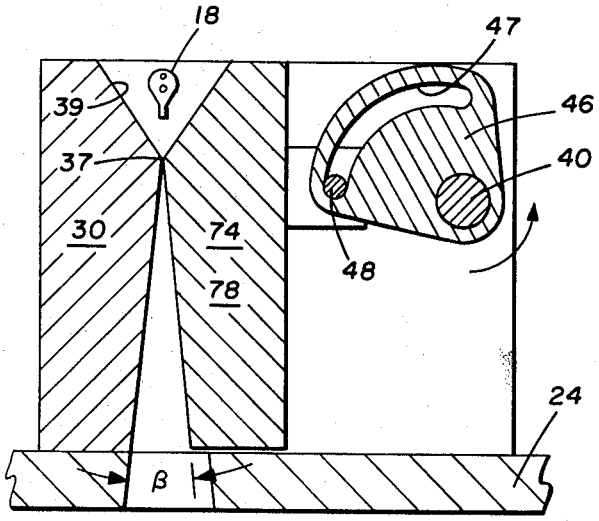

Referring now to FIGS. 9–11, there is illustrated a third embodiment hereof in which movable jaw 32 is longitudinally divided into three separate juxtaposed sections 74, 76 and 78. Each of the jaw sections are operably displaced from fixed jaw 30 as before via rotative operation of cross shaft 40. Displacing outside jaw sections 74 and 78 are separate but similar cams 46 which by a common pitch 47 serve to maintain those jaw sections in longitudinal correspondence at all times. Intermediate idle jaw section 76 is operable by a cam 46' having a pitch 47' different than pitch 47 as to have a different displacement and rate of displacement than the other sections resulting in idle slot 51 as before. In this arrangement, during the first 45 ° rotation of shaft 40 only jaw section 76 is displaced while jaw sections 74 and 78 remain stationary. Thereafter, increased rotation of shaft 40 concomitantly also displaces jaws 74 and 78. This, therefore, enables jaw section 76 to represent the sole throttle response during idle and low speed operation while permitting all the jaw sections to cooperate in providing increased capacity to full throttle operation.

Figure 12:
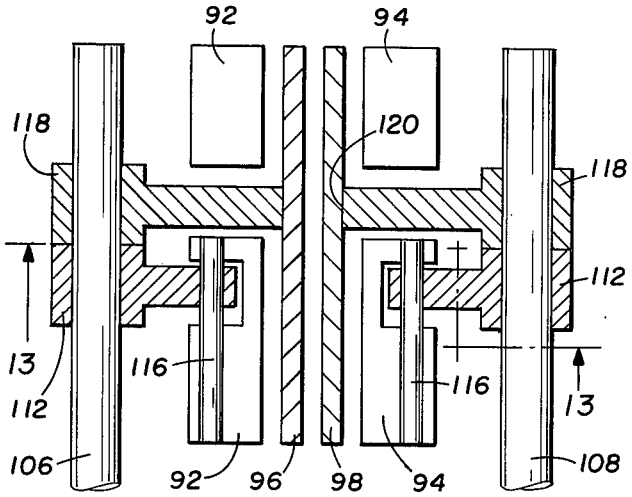
FIG. 12 is a plan view of an apparatus partially in section of a second form of the invention.
Figure 13:
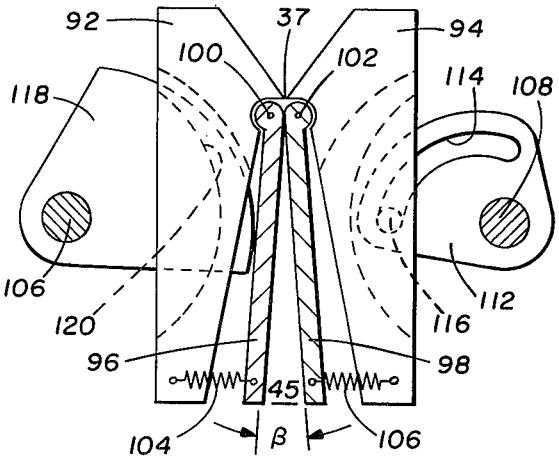
FIG. 13 is a sectional elevation taken substantially along the lines 13—13 of FIG. 12.
Figure 3:
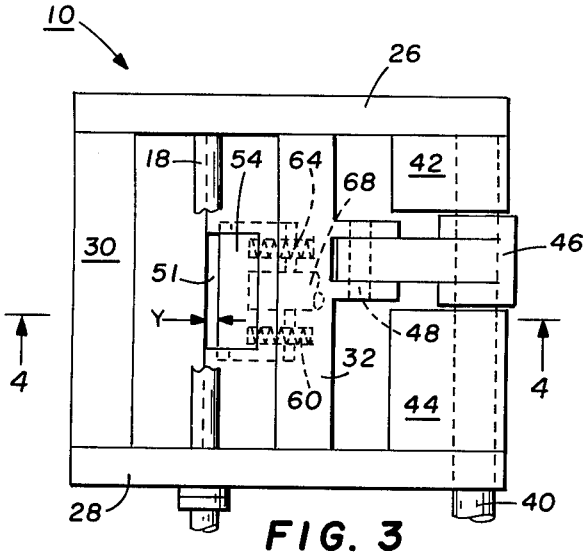
FIG. 3 is a plan view of an apparatus partially in section of a first form of the invention.
Figure 5:
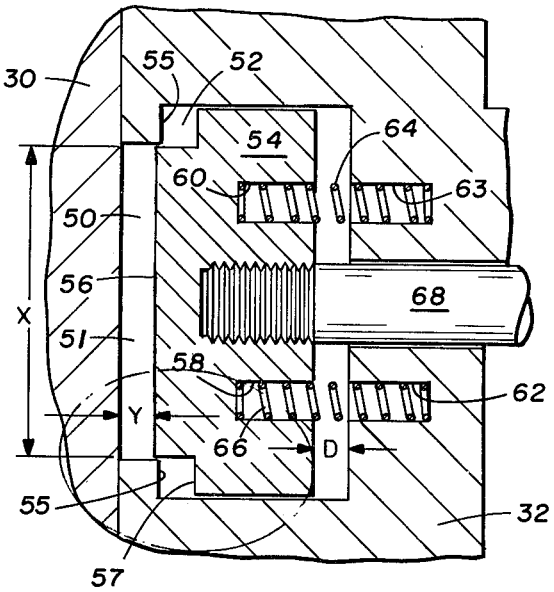
FIG. 5 is an enlarged fragmentary sectional plan view of FIG. 3 illustrating idle operating conditions.
Figure 4:
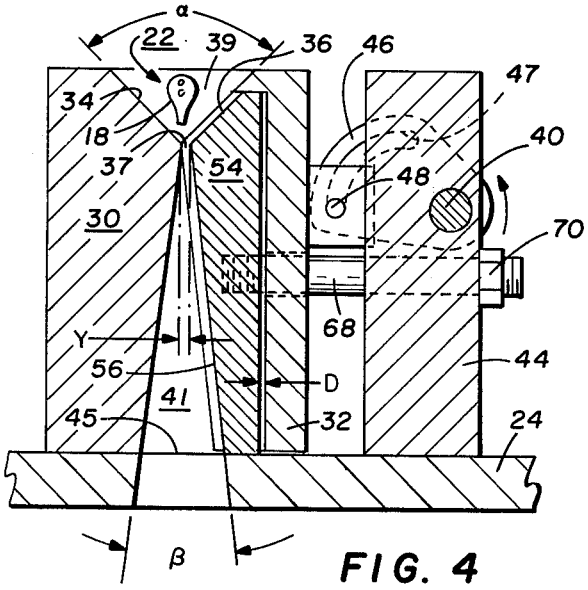
FIG. 4 is a sectional elevation taken substantially along the lines 4—4 of FIG. 3.
Figure 6:
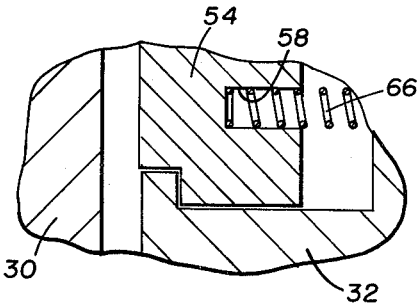
FIG. 6 is an encircled portion of FIG. 5 illustrating non-idle operating conditions.

A second form of the invention for effecting area ratio control will now be described with reference to FIGS. 12 and 13. For purposes hereof, each of opposite jaws 92 and 94 are concomitantly displaceable toward or away from each other as a function of engine demand. The diffuser portion 41 is comprised of opposite diverging diffuser gates 96 and 98 hinge mounted at 100 and 102, respectively, below the level of throat 37. Each of the gates are biased outwardly for increasing angle $\beta$ by tensioned springs 104 and 106 acting to draw the gates against the respective jaw faces thereat.

Operational displacement of the jaws and their companion diffuser gates are controllably effected by a pair of cross shafts 108 and 110 simultaneously rotatable by the throttle linkage similarly as previously described in connection with shaft 40. Each of the shafts carries a first cam 112, which by its defined pitch 114 receiving a follower 116, is enabled on being rotatably displaced to in turn displace its respective jaw 92 or 94. Also carried on each of the shafts is a second juxtaposed cam 118 having a pitched edge 120 engaging the backside of its respective diffuser gate in opposition to the force of springs 104 and 106. By cam 118 having a predetermined pitch, the diffuser angle $\beta$ can be decreased toward idle operation as required for maintaining adequate mixture velocity outward of the exit plane 45. Depending on operational parameters sought to be achieved, change of angle $\beta$ can occur gradually throughout the operational range between idle and WOT or within a partial portion of range as in idle to near idle operation. Decreasing the diffuser angle in this manner likewise causes the area ratio *Aep/At* to decrease enabling exit velocity *Ve* to effect an inversely corresponding increase.

Figure 14:
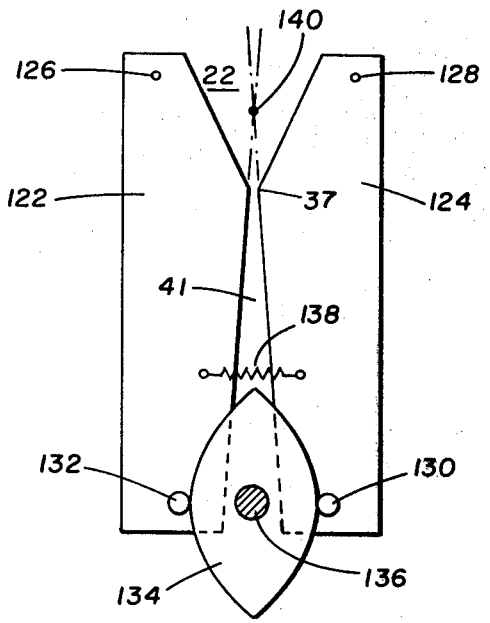
FIGS. 14 and 15 are schematic elevations of a first alternative embodiment in the idle and WOT relations, respectively.
Figure 15:
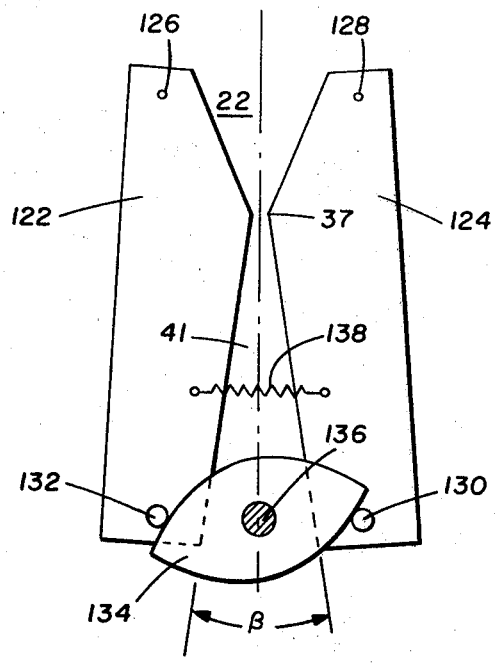

Referring now to FIGS. 14 and 15, there is disclosed a variation of the previous embodiment in which all displacement of opposite jaws 122 and 124 are about pivot pins 126 and 128, respectively. Pins 130 and 132 extend laterally outward of the jaw sides and are engaged by the pitch faces of a cam 134 rotatably supported on cross shaft 136. Driving cam 134 clockwise, as viewed in the drawings, forces separation of the jaws about pivots 126 and 128 in opposition to the tension force of spring 138. In this arrangement, as can be understood by comparing FIGS. 14 and 15, pivotting the jaws by means of cam 134 simultaneously increases or decreases both the passage clearance at throat 37 and the angle $\beta$ in proportion to each other. A proper ratio of change relationship can be established as required for maintaining mixture discharge velocity within the aforementioned limits. To achieve the latter, it may be necessary to locate pivot points 126 and 128 elevated above the jaws. If both jaws are caused to pivot about a common imaginary point 140 in space formed at the elevated intersection of the diffuser planes, the area ratio can be maintained constant over the entire operating range.

Figure 16:
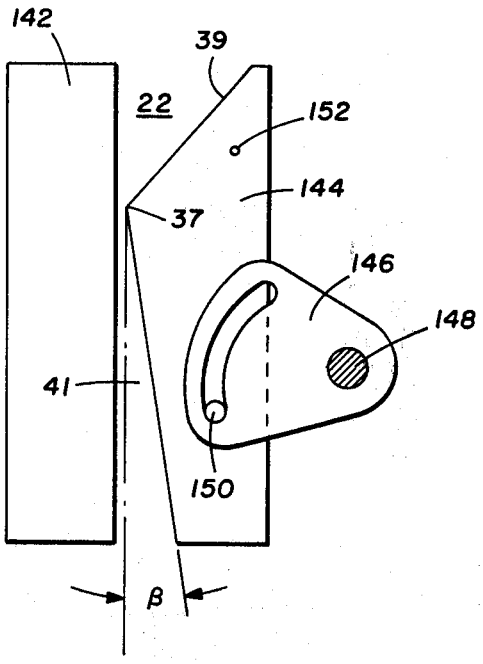
FIGS. 16 and 17 are schematic elevations of a second alternative in the idle and WOT relations, respectively.
Figure 17:
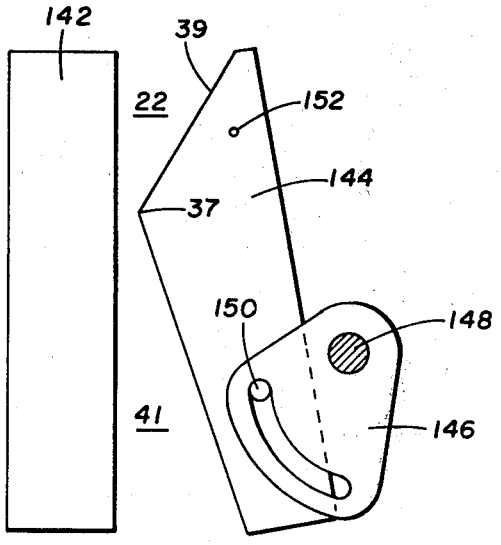

Finally, FIGS. 16 and 17 disclose a still further variation of the foregoing in which the device is comprised of a stationary flat jaw 142 that cooperates with opposite pivotal jaw 144. A cam 146, similar to cam 46 described above, is angularly displaceable by means of cross shaft 148 to in turn displace follower pin 150 for rotating jaw 144 about pin axis 152. In this arrangement the entire angle $\beta$ of diffuser 41 is contained in jaw 144 and is comparable to the preferred range of diffuser angles previously indicated. Likewise preferred for this arrangement is that the area of intake 39 to the area of throat 37 exceed about 4 to 6:1.

By the above description there has been disclosed novel apparatus for supplying air-fuel idle requirements to an internal combustion engine through a variable venturi device. Controllably adjusting the area ratio between the throat and exit planes of the device enables discharge velocity of the air-fuel mixture to be maintained within preferred limits. With discharge velocity being appropriately maintained, the undesirable impaction or agglomeration of fuel droplets can be readily avoided for enhancing engine operation. While achieving area ratio control in accordance with the invention has been disclosed in the form of separate structural embodiments, it should be apparent that aspect ratio and/or angle features of each can be readily combined in varying degrees into a single apparatus for achieving the objectives hereof.

Since many changes could be made in the above construction and many apparently widely different embodiments of this invention could be made without departing from the scope thereof, it is intended that all matter contained in the drawings and specification shall be interpreted as illustrative and not in a limiting sense.

The embodiments of an invention in which an exclusive property or privilege is claimed are defined as follows:

1. In a liquid fuel and intake air mixing and modulating device for supplying a combustion mixture to an internal combustion engine as a high velocity air stream incurring sonic velocity over most of the operating range of the engine to which it is supplied by efficient kinetic energy conversion of the air stream to static pressure and including a housing; oppositely positioned members within said housing defining by their walls a venturi flow passage intervening therebetween; fuel intake means to receive quantities of liquid fuel to be introduced in a substantially uniform pattern into said passage; and adjustment means operative to vary the flow area of said passage in correlation to operating demands imposed upon the engine, the improvement comprising control means operative to reduce the divergence angle of the venturi diffuser concomitantly with adjustment means variation of said passage toward idle operation for adjustably varying the area ratio between the exit plane of said passage and the throat plane of said passage to within a predetermined range from between less than about 21:1 at idle and greater than about 1.3:1 at wide open throttle.

2. In a liquid fuel and intake air mixing and modulating device according to claim 1 in which at least one of said members is pivottally supported and said adjustment means and control means are an operative unit to pivot said member about its pivot axis for varying said passage flow area while simultaneously varying said area ratio.

3. In a liquid fuel and intake air mixing and modulating device according to claim 2 in which each of said members are pivottally supported and said adjustment means and control means are operative to concomitantly pivot both of said members.

4. In a liquid fuel and intake air mixing and modulating device according to claim 1 in which said predetermined range of area ratios is effective to maintain flow velocity past said exit plane to within a predetermined velocity range throughout the operational range of said adjustment means.

5. In a liquid fuel and intake air mixing and modulating device according to claim 4 in which said control means is effective to limit maximum flow velocity past said exit plane determined at unchoke point to about 500 feet per second at wide open throttle operation of said adjustment means.

6. In a liquid fuel and intake air mixing and modulating device according to claim 4 in which said control means is effective to limit minimum flow velocity past said exit plane determined at unchoke point to about 30 feet per second at idle operation of said adjustment means.

7. In a liquid fuel and intake air mixing and modulating device for supplying a combustion mixture to an internal combustion engine as a high velocity air stream incurring sonic velocity over most of the operating range of the engine to which it is supplied by efficient kinetic energy conversion of the air stream to static pressure and including a housing; oppositely positioned members within said housing, said members comprising walls supported in angularly fixed relation to each other and defining a venturi flow passage intervening therebetween; fuel intake means to receive quantities of liquid fuel to be introduced in a substantially uniform pattern into said passage; and adjustment means operative to vary the flow area of said passage in correlation to operating demands imposed upon the engine without changing the angular relation between the passage defining walls of said members, the improvement comprising control means for adjustably varying the area ratio between the exit plane of said passage and the throat plane of said passage to within a predetermined range from a ratio at wide open throttle operation of the engine of about 1.3:1 by effecting an idle operation passage area aspect ratio measured at said throat plane different than the aspect ratio defined by the throat plane area over the longitudinal extent of said members.

8. In a liquid fuel and intake air mixing and modulating device according to claim 7 in which said adjustment means includes displacement means to operatively displace at least one of said members toward and away from the other and said control means comprises means defining a longitudinally localized flow area within the longitudinal extent of said members.

9. In a liquid fuel and intake air mixing and modulating device according to claim 8 in which said displacement means comprises means to move at least one of said members laterally relative to both the axis of said passage and to the other of said members for operatively varying the flow area of said passage and said control means comprises a recess defined in a passage defining wall locally intermediate in the face of at least one of said members for effecting said idle operation passage independent of the entire remaining longitudinal extent of the passage.

10. In a liquid fuel and intake air mixing and modulating device for supplying a combustion mixture to an internal combustion engine as a high velocity air stream incurring sonic velocity over most of the operating range of the engine to which it is supplied by efficient kinetic energy conversion of the air stream to static pressure and including a housing; oppositely positioned members within said housing defining by their walls a venturi flow passage intervening therebetween; fuel intake means to receive quantities of liquid fuel to be introduced in a substantially uniform pattern into said passage; and adjustment means operative to vary the flow area of said passage in correlation to operating demands imposed upon the engine, the improvement comprising at least one of said members including a diffuser gate pivotally supported therefrom for defining the diffuser portion thereof and control means for adjustably varying the area ratio between the exit plane of said passage and the throat plane of said passage to within a predetermined range from a ratio at wide open throttle operation of the engine of about 1.3:1 by reducing the divergence angle of said gate concomitantly with adjustment means variation of said passage toward idle operation.

11. In a liquid fuel and intake air mixing and modulating device according to claim 10 in which each of said members includes a diffuser gate and said control means is operative for simultaneously reducing the divergence angle of both of said gates.

* * * * *